US009427994B2

(12) United States Patent
Naivelt

(10) Patent No.: US 9,427,994 B2
(45) Date of Patent: Aug. 30, 2016

(54) APPARATUS AND METHOD OF TENSIONING PRINT MEDIA

(75) Inventor: Vladimir Naivelt, Petach Tiqwa (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 2987 days.

(21) Appl. No.: 11/740,527

(22) Filed: Apr. 26, 2007

(65) Prior Publication Data

US 2008/0266346 A1 Oct. 30, 2008

(51) Int. Cl.

| | |
|---|---|
| ***B41J 2/01*** | (2006.01) |
| ***B41J 2/17*** | (2006.01) |
| ***B41J 2/135*** | (2006.01) |
| ***B41J 2/165*** | (2006.01) |
| ***B41J 29/02*** | (2006.01) |
| ***B41J 11/00*** | (2006.01) |
| ***B41J 11/04*** | (2006.01) |
| *B41J 2/03* | (2006.01) |

(52) U.S. Cl.

CPC ..... *B41J 29/02* (2013.01); *B41J 11/0005* (2013.01); *B41J 11/04* (2013.01); *B41J 2002/031* (2013.01)

(58) Field of Classification Search

CPC ..... B41J 15/16; B41J 11/20; B41J 11/005; B41J 2002/031; B41J 29/02; B41J 11/04

USPC ..... 347/37, 38, 101, 104, 105; 271/72, 178, 271/275–277, 307, 309, 310; 346/103, 134, 346/138; 399/143, 165, 176, 361; 400/144.3, 145.1, 145.2, 583.2, 618

See application file for complete search history.

(56) References Cited

U.S. PATENT DOCUMENTS

| | | | | |
|---|---|---|---|---|
| 5,771,054 | A * | 6/1998 | Dudek et al. | 347/102 |
| 6,074,056 | A * | 6/2000 | Kubo et al. | 347/104 |
| 7,000,917 | B2 * | 2/2006 | Helmstadter et al. | 271/276 |
| 2001/0015523 | A1 * | 8/2001 | Helmstadter et al. | 271/276 |
| 2002/0085054 | A1 * | 7/2002 | Tokie | 347/15 |
| 2005/0092200 | A1 * | 5/2005 | Beauchamp et al. | 101/409 |

* cited by examiner

*Primary Examiner* — Thomas A Hollweg
*Assistant Examiner* — Hung Lam
(74) *Attorney, Agent, or Firm* — HP Inc Patent Department

(57) ABSTRACT

A method of tensioning a print medium on a drum comprising: supporting the medium on the drum; rotating the drum; and applying a gaseous flow to the medium on the drum, the gaseous flow having a major component that is tangential to the drum and in a direction that is opposite to the linear direction of the surface of the drum.

3 Claims, 7 Drawing Sheets

APPARATUS AND METHOD OF TENSIONING PRINT MEDIA

An embodiment of the invention provides an ink jet printer comprising: a rotatable drum for supporting a print medium; a motor operable to rotate the drum; an air nozzle directed substantially tangentially to the surface of the drum in a direction that is substantially opposite to the linear direction of the drum; and a printhead operable, in use, to eject ink onto the substrate supported by the drum after the substrate has been treated by the air nozzle.

In some embodiments the ink jet printer is a wide-format printer.

An embodiment of the invention provides a method of pressing a print medium against a printer drum comprising; placing the print medium on the drum; rotating the drum; and applying a substantially laminar flow of air to the print medium on the drum in a direction that is substantially opposite to the direction of the rotating drum thereby applying a tensioning force to the print medium.

An embodiment of the invention provides a method of flattening print media against a printing drum comprising: directing a substantially laminar gas flow across the medium, whilst the medium is on the drum, at a direction that is substantially tangential to the drum.

An embodiment of the invention provides a printing apparatus comprising: a rotatable drum adapted to receive a print medium around at least part of the drum's circumference; and a gas nozzle directed substantially tangential to the circumference of the drum.

An embodiment of the invention provides an apparatus comprising: support means for supporting a print medium means; and air flow means for directing air at the print medium means, the air flow means being directed substantially tangentially at the print medium means when the print medium means is on the support means.

An embodiment of the invention provides use of an air knife to simultaneously flatten and cool a print medium on a medium carrier.

Embodiments of the invention are configured to produce a volumetric flow rate of gas that is equal to or greater than 100 standard cubic feet per minute. Embodiments of the invention are configured to produce a volumetric flow rate of gas that is equal to or greater than 200 standard cubic feet per minute.

The medium carrier may be substantially flat or it may be a roller or other rotatable surface. Such a rotatable surface will generally comprise a convex surface for supporting the medium.

An embodiment of the invention provides an air nozzle and an attachment for fitting the air nozzle to an ink jet printer so that the air nozzle is substantially tangential to the printing drum of the ink jet printer.

Generally this embodiment of the invention will also include instructions on how to fit the air nozzle to the ink jet printer so that the air nozzle is substantially tangential to the printing drum of the ink jet printer.

In an embodiment of the invention the nozzle/air knife is directed substantially tangentially to the drum and substantially in the same direction as the linear velocity of the rotating drum. In this embodiment the medium is still flattened against the drum.

An embodiment of the invention provides a method comprising transporting a print medium on a support in a first direction and applying an air flow having a major component that is in a direction that is opposite to said first direction so as to apply a tensioning force to the print medium.

An embodiment of the invention provides apparatus comprising support means having a surface for supporting a print medium and a gas ejection means for directing gas at the surface of the transport means wherein the gas ejection means is orientated to eject gas at the surface such that in use the print medium is pressed onto the transport means.

It should be appreciated that embodiments and aspects of the invention that are defined in a particular category (e.g. a method) then the same embodiment or aspect can also be defined as other categories (e.g. as a printing system or a printer). The skilled person will understand that the features and embodiments of the invention that are described and claimed may be combined in various ways.

BRIEF DESCRIPTION OF DRAWINGS

Embodiments of the invention will now be described, by way of example only, with reference to the accompanying drawings, of which.

SPECIFIC DESCRIPTION

Figure 1:
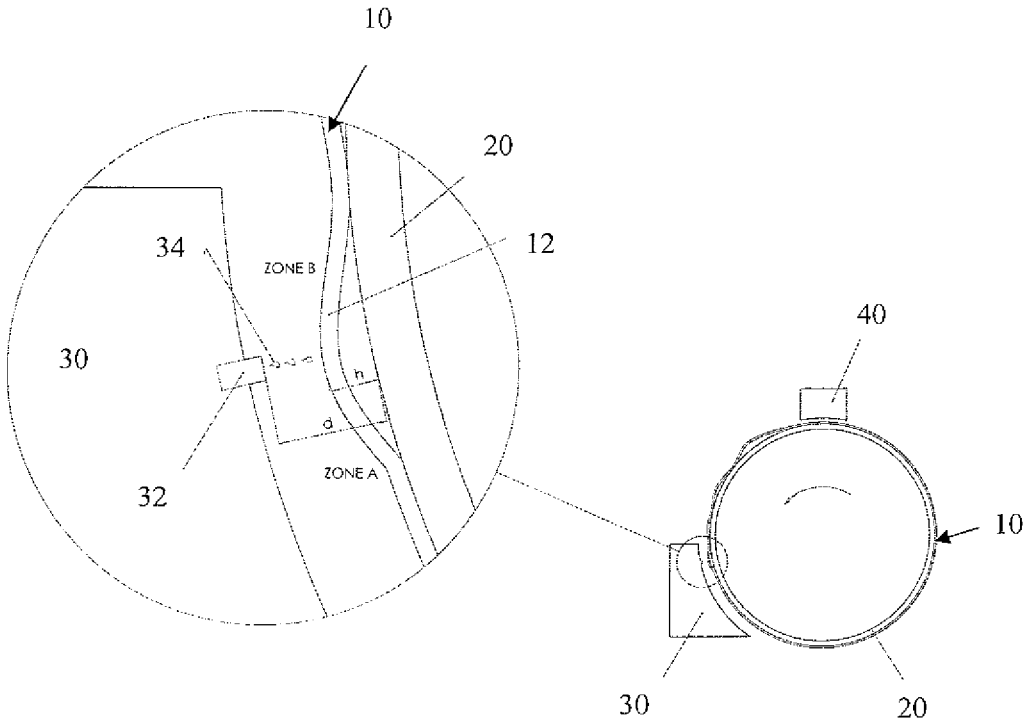
FIG. 1 schematically illustrates a printing system.

FIG. 1 illustrates a printing apparatus comprising a drum 20 upon which a print medium 10 is wound and a means for applying ink 34 to the medium 10. In the specific example illustrated in FIG. 1 the printing apparatus is an ink jet printer in which the ink applying means is a printhead 32 which is supported by a printhead carriage 30. The carriage 30 moves in relation to the drum 20 so that a printed image may be built up on the medium 20 as the drum 20 rotates. Although a specific embodiment of the invention is described in relation to ink jet printers it should be appreciated that embodiments of the invention can be realised with other types of printer eg dry tone laser printers, liquid electrophotographic printers (eg LEPs and LED printers) to name a few.

Figure 2:
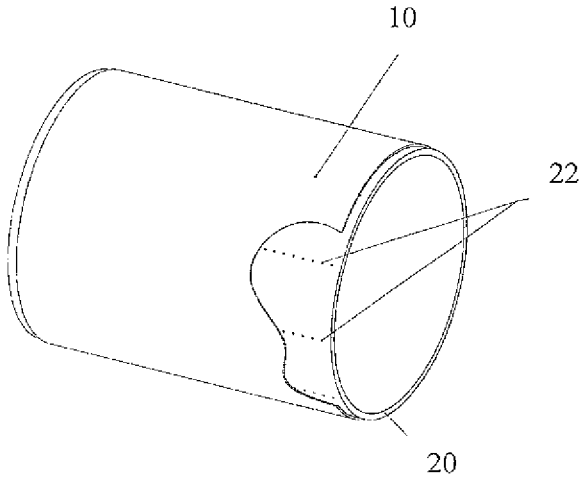
FIG. 2 schematically illustrates a print medium wrapped on a printing drum.

FIG. 2 illustrates the drum 20 in more detail. In particular, in the example drum illustrated, the drum 20 has a number of vacuum holes 22 so that once the medium 10 has been wound onto the drum 20 the medium 10 may be held onto the drum surface by vacuum forces applied through the vacuum holes 22. Vacuum holes 22 are often used on large format printers (sometimes also called "wide format printers"). In large format printers the circumference of the drum 20 may be from about half a meter to several meters.

Figure 3:
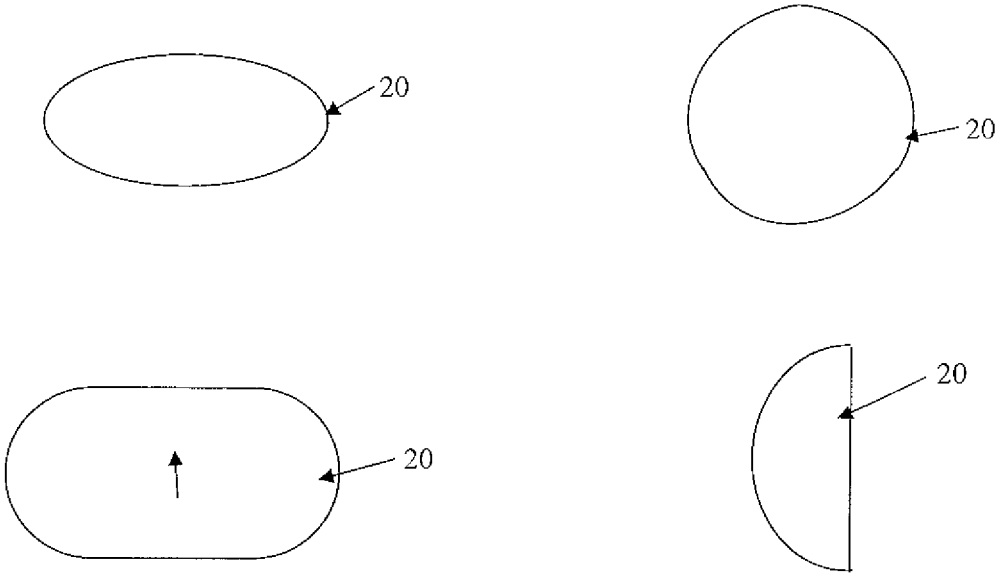
FIG. 3 schematically illustrates, in cross-section, some example drums that can be used according to embodiments of the invention.

Although the drum 20 illustrated is a cylinder having a substantially circular cross-section, embodiments of the invention are not necessarily limited to any particular geometry. The main requirement of the drum is that it is able to transport the medium 10 so as to present the medium to the ink applying means (i.e. the printhead 22 in FIG. 1). As illustrated in FIG. 3, the drum 20 may therefore have a non-circular cross-section such as an elliptical cross-section D-shaped cross-section or have a shape/configuration that produces a cam. Generally the drum 20 will have a convex surface for supporting the print medium 10 although embodiments of the invention can use a flatbed medium carrier (described in more detail herein below).

The print medium 20 can be any of a wide range of substrates including paper, vinyl, textiles or polypropylene films such as that known YUPO® (sometimes referred to as "synthetic paper") or other types of polymer film.

Large format printing devices, the medium carrier may have a length of several tens of centimetres to several meters (the length being defined in relation to a process direction of the printing apparatus), for example in printers in which the print carrier is a drum 20 the drum 20 may have a circumference of the order of 0.5 meter to several meters. Large format printing devices are generally operated in a controlled environment because small temperature changes can cause significant variations in the size of the printed image and/or degrade image registration. The problem can be severe when flexible printing substrates such as YUPO® are used.

The drum 20 may be operable to repeatedly pass under a printhead 32 and a source of drying or curing 40 as illustrated in FIG. 1. This processing produces heat and the difference in the temperature of the print medium 10 at the end of the printing process compared to the temperature of the print medium 10 at the start of the printing process may be several Celsius and may be as high as 15 to 20 Celsius. This increase in temperature causes the print medium 10 to swell to produce a deformed area 12 of the medium 10 on the drum 20. For a drum 20 having a circumference of about 5 meters the ends of the same substrate may expand by a few millimetres. Despite the use of a vacuum to hold the print medium 10 against the drum 20 the difference in size of the print medium 10 from the beginning to the end of the printing process causes sections of the medium 20 to be released from the drum 20. This causes a loss of image registration and degrades the quality of the printed image.

FIG. 1 includes an enlarged view of a section of the print medium 10 in the vicinity of the print head 32. The swelling of the medium 10 produces print artefacts for example by causing areas different densities of colours than that which were intended (zone A and zone B on FIG. 1). FIG. 1 shows an area 12 of the medium 10 that has deformed so that it has become detached from the drum 20 so that the printing surface of the medium 10 is at height h above the surface of the drum 20. When the swelling is such that the height h exceeds the distance d of the printhead 32 above the drum 20 then the ink 34 fired by the printhead 32 will be smeared on the medium 10 and the printhead 32 can become damaged. Typically distance d is about 1.5 mm for large format printers.

Figure 4:
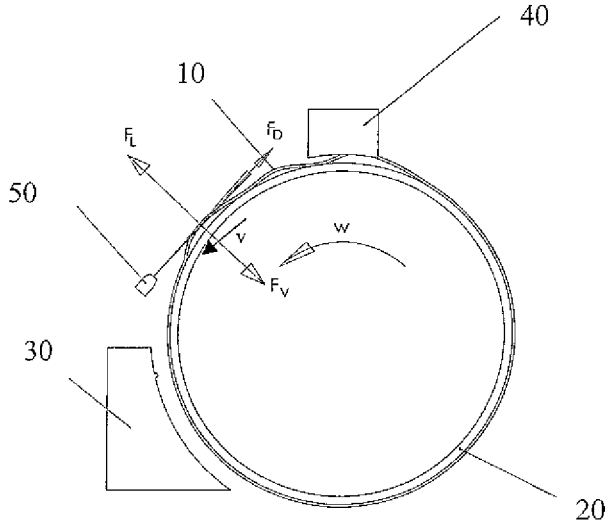
FIG. 4 schematically illustrates a printing system incorporating an air knife according to an embodiment of the invention.

Referring to FIG. 4, according to an embodiment of the invention a nozzle 50 is used to direct gas at the medium 10. Although other gases may conceivably be used the gas is generally air since it is cheaper than other gases and is not flammable or toxic. In an embodiment of the invention the nozzle 50 produces a high intensity uniform sheet of airflow. Such airflow is often referred to in the manufacturing arts as an "air knife". The term "air knife" is also commonly used to refer to the nozzle which produces such an airflow. The airflow is directed at the medium 10 on the drum 20 so that the airflow applies a substantially tangential force to the medium 10. The airflow is generally applied over all or most of the axial length of the drum 20. This may be achieved using a nozzle 50 which has an opening for producing the airflow wherein the opening has an axial extent which is as long as most or all of the axial length of the drum 20 or longer than the axial length of the drum 20.

The Coanda effect, also known as "boundary layer attachment", is the tendency of a stream of fluid to stay attached to a surface. For example a stream of fluid may stay attached to a convex surface rather than follow a straight line in its original direction. The Coanda effect keeps the air stream produced by the nozzle 50 attached to the surface of the drum 20. This is advantageous because it keeps the airflow in the direction required, for example, tangentially to the drum surface and/or in the direction opposite to the linear velocity of the drum surface. Additionally, the Coanda effect causes the jet of air to have a larger area of contact with the medium 10 on the drum 20 thereby flattening and cooling a larger area of the medium 10. There is a smooth temperature gradient within the airflow attached to the drum 20 so that there is no temperature shock to the medium 10 below the air knife.

Figure 5:
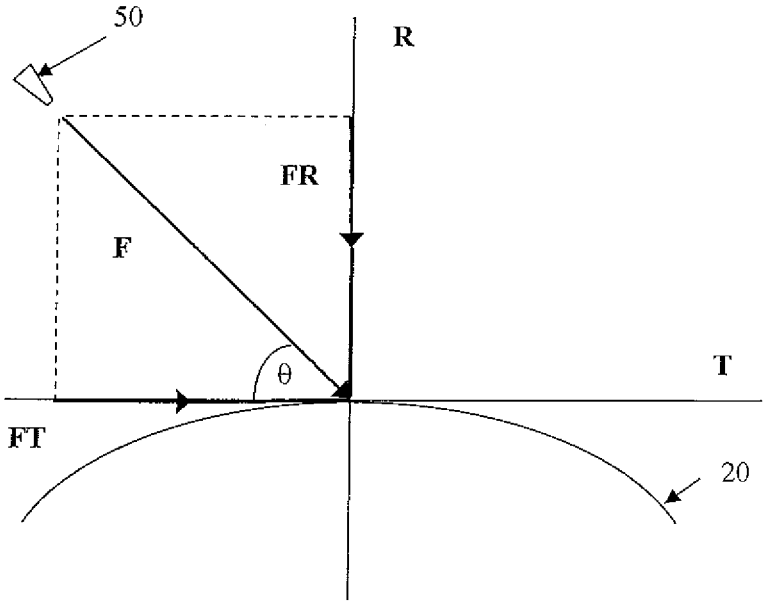
FIG. 5 schematically illustrates an air nozzle and a set of reference axes in relation to a printing drum.

FIG. 5 illustrates an axis system with reference to the drum 20 in which the T axis is in the tangential direction to the drum's surface and the R axis is in a direction that extends radially from the drum's surface (i.e. orthogonal to the T axis). A nozzle directed at an angle $\Theta$to the tangent to the drum's surface is operated to produce an airflow with a force F against the surface of a print medium 10 supported by the drum 20. The force F has a force component in the tangential direction, $F_T$=F cos $\Theta$, and a force component in the radial direction, $F_R$=F sin $\Theta$. Preferably the airflow is directed so that most of the force F will act in the tangential direction T. That is, nozzle 50 is directed at the drum surface with an angle of less than 45 degrees so that the major component of the force F produced by the airflow will be in the tangential direction T.

Figure 6:
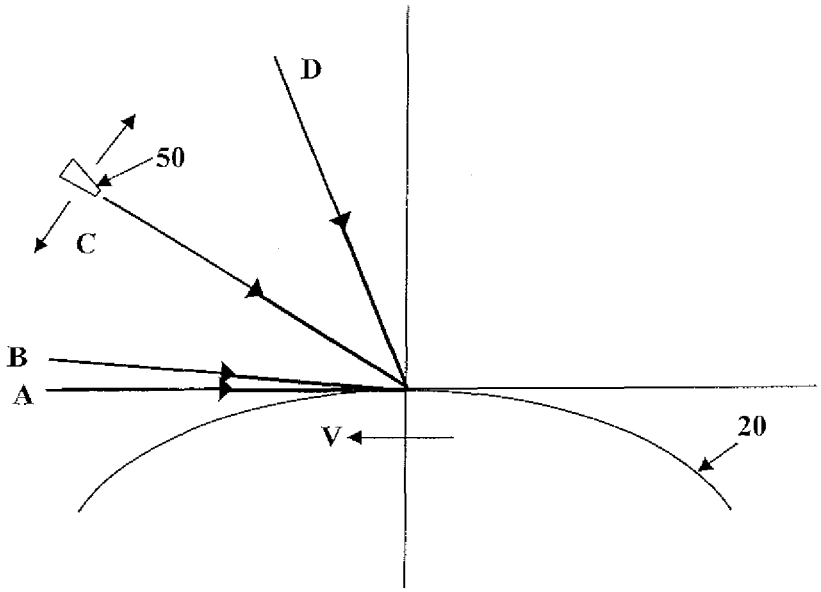
FIG. 6 schematically illustrates various orientations of an air nozzle in relation to a printing drum.

FIG. 6 illustrates the nozzle 50 orientated in several different positions (A, B, C, D) relative to the surface of the drum 10. The nozzle 50 may be orientated substantially tangentially to the drum 20 (position A) so that the airflow exiting the nozzle 50 produces a force F that acts tangentially on the medium 10 on the drum 20. If the nozzle is position at a slight angle to the tangent to the drum 20 (position B), e.g. 15 degrees, the force F will still be substantially tangential (e.g. $F_T$=F cos15=0.97 F). As the angle, $\theta$, approaches 45 degrees (position C) the tangential component of the force F decrease but it is still the major component (i.e. it is larger than the radial component of the force $F_R$), At $\theta$=45 degrees the resolved components are equal ($F_T$=$F_R$) and at $\theta$>45 degrees (eg at position D) the radial component takes over as the major component of the force F.

When the tangential component of the force produced by the airflow is acting in a direction that is opposite to the linear velocity, v, of the medium 10 on the drum 20 (at the position that the airflow intercepts the medium 10) then there is a relative velocity between the airflow and the medium 10 that is higher than the velocity of the airflow itself. The airflow produces a drag force $F_D$ on the medium 10. This drag force acts to tension the medium 10 on the drum 20 and, as a consequence flattens the medium 10 against the drum 20. Higher relative velocities between the airflow and the medium 10 can produce higher forces tending to flatten the medium 10 to the drum 20.

Referring again to FIG. 4, a lifting force FL acting on the medium 10 is shown. The lifting force is caused by the airflow over the medium 10 causing a reduced pressure compared to the pressure below the medium 10.

Generally the airflow is substantially laminar however in some embodiments the flow is not laminar but has an overall direction that is substantially opposite to the direction of rotation of the drum 20.

The nozzle 50 may produce an airflow that is substantially laminar across a portion of the airflow and it is this portion that is directed to intercept the drum 20. In one example the nozzle 50 may have an elongated slot from which the airflow is ejected and the elongated slot is substantially aligned with the axis of the drum 20. In this case it may be possible that the flow deviates from a substantially laminar flow at the edges of the flow (in the axial direction). In this situation the deviation may be acceptable if the portion of the flow exhibiting the deviation is small compared to the substantially laminar portion of the flow. Alternatively, the slot may have an axial extent that is longer than the axial length of the drum so that at least some of the portion that deviates from a substantially laminar flow does not intercept the drum 20.

The stream of air that passes over the drum 20 involves a large volume of air from the surrounding environment along with the small amount of compressed air from the air knife itself. This large volumetric flow of air has a large cooling effect on the medium 10.

The airflow passing through the nozzle 50 may be cooled or temperature controlled. For example, a cooler may be used to cool the air before it enters the nozzle 50. The temperature of the airflow may be controlled so that it is cooler than the ambient temperature of the air surrounding the drum 20.

The nozzle 50 and/or cooler can be retrofitted to a printing system to produce the desired airflow over the medium 10 on the drum 20. The nozzle 50 may therefore be supplied with an attachment for attaching the nozzle to the printing system at the required angle (e.g. substantially tangentially to the printing drum 20). The attachment may attach the nozzle 50 at a fixed angle to the drum 20 or may allow for the required angle to be set by a user. A set for retrofitting a nozzle 50 may comprise instructions for fitting the nozzle at the required angle (e.g. substantially tangentially to the printing drum 20), the nozzle 50 and the attachment.

Figure 7:
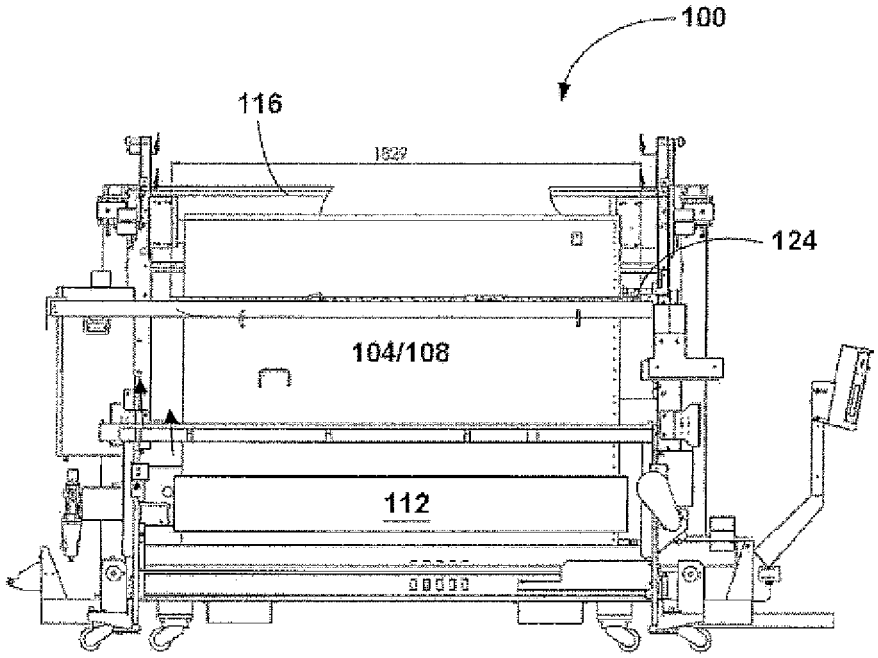
FIG. 7 illustrates a front view of a large format inkjet printing drum machine.
Figure 8:
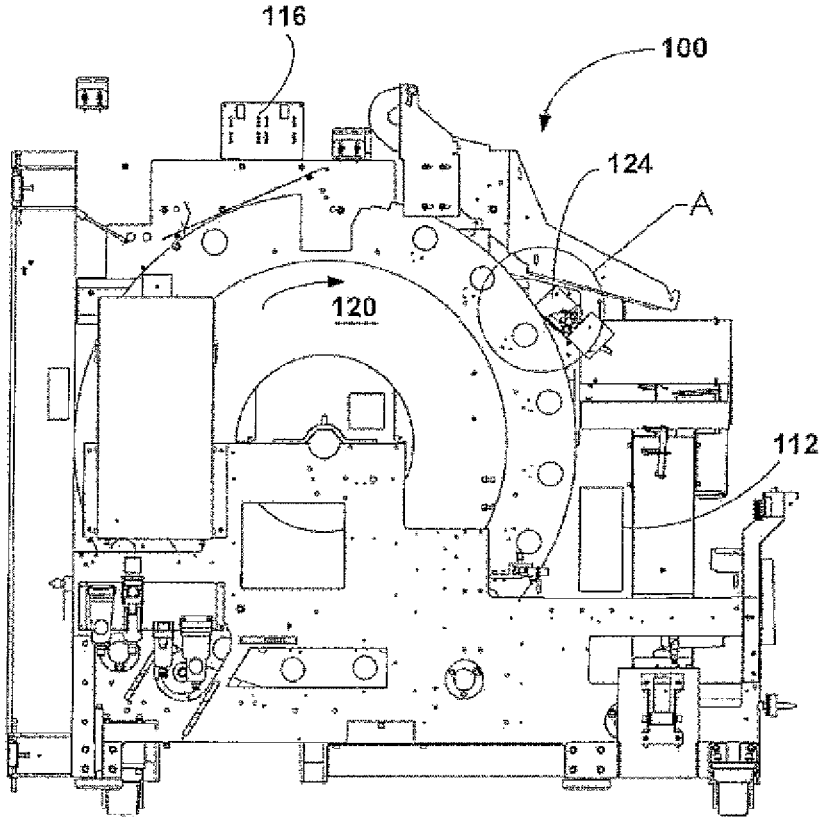
FIG. 8 illustrates a side view of the inkjet printing drum machine illustrated in FIG. 7.

FIG. 7 is a schematic, frontal view illustration of a large format inkjet printing drum machine 100 and FIG. 8 is a schematic, side view illustration of the same machine 100. Machine 100 includes a drum 104 that holds the substrate (print medium) 108, which may be a vinyl, paper, YUPO type material or other flexible material. Printhead 112 prints successive swathes of the image and progresses from one machine end to the other machine end (from left to right as illustrated in FIG. 8). Associated with the printhead movement is a wide source 116 of curing energy, such as a UV lamp. Arrow 120 indicates drum rotation direction. Under the influence of heat generated by lamp 116, the substrate 108 changes its size and certain sections of it may even bulge, this is despite the substrate being held down on the drum by a vacuum.

Figure 9:
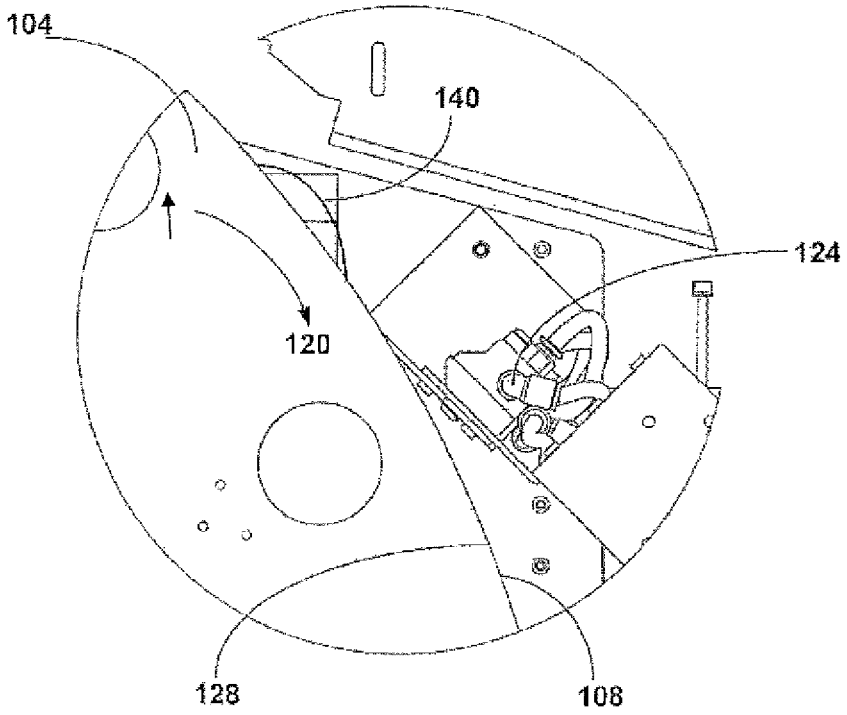
FIG. 9 illustrates a detail of the inkjet printing drum machine illustrated in FIGS. 7 and 8.

FIG. 9 is a schematic expansion of a section of the machine marked A that illustrates a bulge 140 in the medium 10.

Traditional cooling devices, even those providing a large volume of air do not cool sufficiently'substrate 108 or drum 104, nor are they capable of attaching substrate 108 to the surface of the drum. Use of water-cooling may complicate and would generally be used for cooling the drum 20 rather than directly cooling the substrate 108. Air knife 124 is installed in such a way that a high intensity, balanced stream of laminar airflow across the entire width of the drum is directed tangential to the drum 104 surface. Such air knife installation generates a strong "laminar" flow in excess of 250 SCFM (standard cubic feet per minute) of air along the drum circumference. The Coanda effect keeps the air stream attached to the drum surface 128. This develops pressure on the substrate 108 and keeps it attached to the drum surface 128. The stream involves a large volume of air from the surrounding area along with the small amount of compressed air from the air knife itself. The amount of air involved is more than a magnitude larger than the one produced by conventional cooling means. The method described maintains the temperature of the drum 104 and substrate 108 in the range of ±2.0 Celsius in course of a five minute printing cycle and keeps the substrate 108 firmly attached to drum surface 128.

In an embodiment of the invention the printer is a flat-bed printer that uses a flat-bed medium carriage to transport the print medium with respect to the printing means, In this embodiment the air knife is directed substantially in the direction of the plane of the medium supported on the medium carriage. Flatbed printers generally use less flexible print media than drum based printers however medium expansion can still be a problem and the use of an air knife as described above can be used to improve the print quality of the printed medium.

Thus, while the present invention has been described in terms of preferred embodiments, it will be appreciated by one of ordinary skill that the spirit and scope of the invention is not limited to those embodiments, but extends to the various modifications and equivalents as defined in the appended claims.

We claim:

1. A method of tensioning a print medium on a drum comprising:

supporting the medium on the drum; rotating the drum; and applying a gaseous flow to the medium on the drum, the gaseous flow having a major component that is tangential to the drum and in a direction that is opposite to the linear direction of the surface of the drum; and controlling the temperature of the gaseous flow.

2. A printing apparatus comprising a drum for receiving a print medium and a nozzle directed substantially tangentially at the drum;

in which said nozzle is positioned such that a gaseous flow exits said nozzle to pass over said print medium when said print medium is disposed on said drum, said gaseous flow having a major component tangential to said drum that creates tension along a length of said print medium disposed on said drum; and a cooler operable to cool gas before the gas exits the nozzle in said gaseous flow.

3. The printing apparatus of claim 2 wherein the cooler has a variable control operable to adjust the temperature of the gas exiting the air nozzle.

* * * * *